US007028868B2

(12) United States Patent
Kendall et al.

(10) Patent No.: US 7,028,868 B2
(45) Date of Patent: Apr. 18, 2006

(54) REFRACTORY NOZZLE

(75) Inventors: Martin Kendall, Hasselt (BE); Chris Hallam, Stevoort (BE)

(73) Assignee: Heraeus Electro-Nite International N.V., Houthalen (BE)

( * ) Notice: Subject to any disclaimer, the term of this patent is extended or adjusted under 35 U.S.C. 154(b) by 0 days.

(21) Appl. No.: 10/191,906

(22) Filed: Jul. 8, 2002

(65) Prior Publication Data

US 2003/0011113 A1 Jan. 16, 2003

(30) Foreign Application Priority Data

Jul. 13, 2001 (DE) ..... 101 33 557
Oct. 11, 2001 (DE) ..... 101 50 032

(51) Int. Cl.
*B22D 41/50* (2006.01)

(52) U.S. Cl. ..... 222/594; 222/591; 222/597; 266/236

(58) Field of Classification Search ..... 222/590, 222/591, 594, 597, 600, 606; 266/236; 164/435, 164/437
See application file for complete search history.

(56) References Cited

U.S. PATENT DOCUMENTS

| | | | | |
|---|---|---|---|---|
| 4,386,765 | A * | 6/1983 | Roberts et al. | 266/236 |
| 4,568,007 | A | 2/1986 | Fishler | |
| 4,776,502 | A | 10/1988 | Hagenburger et al. | |
| 5,587,101 | A * | 12/1996 | Hattanda et al. | 222/603 |

FOREIGN PATENT DOCUMENTS

| | | | |
|---|---|---|---|
| DE | 28 07 123 | | 8/1979 |
| DE | 28 07 123 | A1 | 8/1979 |
| DE | 296 03 426 | U1 | 6/1996 |
| DE | 196 54 402 | C1 | 12/1997 |
| EP | 0 379 647 | A2 | 8/1990 |
| EP | 0 379 647 | B1 | 9/1993 |
| FR | 1493389 | | 9/1966 |
| GB | 1083262 | | 9/1967 |
| GB | 1144725 | | 3/1969 |
| GB | 1194488 | * | 6/1970 |
| GB | 1209598 | * | 10/1970 |
| GB | 2 157 210 | A | 10/1985 |
| JP | 58-020355 | | 2/1983 |
| JP | 02063656 | A * | 3/1990 |
| JP | 1019910002173 | | 4/1991 |
| JP | 6142899 | A | 5/1994 |
| JP | 09314293 | | 12/1997 |
| JP | 10113753 | | 5/1998 |
| JP | 11156501 | | 6/1999 |

* cited by examiner

*Primary Examiner*—Scott Kastler
(74) *Attorney, Agent, or Firm*—Akin Gump Strauss Hauer & Feld, LLP

(57) ABSTRACT

A refractory nozzle is provided for arrangement in or on a wall of a metallurgical crucible, particularly for steel melts, having a discharge duct surrounding a flow passage, wherein the discharge duct has a surface delimiting the flow passage and an outer housing. In order to improve the known solutions of the prior art, one embodiment of the nozzle is characterized by the discharge duct having an upper part and a lower part with the lower part being fixed in or on the upper part, wherein the surface of the upper part delimiting the flow passage is made of a different material than the surface of the lower part delimiting the flow passage. In a second embodiment the nozzle is characterized by the discharge duct having an upper part and a lower part with the lower part being fixed on or in the upper part, wherein the diameter of the flow passage in the upper part is greater than the diameter in the lower part.

6 Claims, 1 Drawing Sheet

REFRACTORY NOZZLE

BACKGROUND OF THE INVENTION

The invention concerns a refractory nozzle for arrangement in or on a wall of a metallurgical crucible, particularly for steel melts, having a flow passage and a discharge duct surrounding the flow passage, wherein the discharge duct has a surface delimiting the flow passage and an external housing. Such devices are needed in the casting industry in order to make it possible for metal melts, particularly steel melts, to run out of melt crucibles.

An arrangement of this type is known, for example, from British patent specification GB 2 157 210 A. Here, a so-called immersion nozzle is described, from which molten steel flows from an upper crucible into a lower melt crucible, wherein the nozzle or spout dips into the melt of the lower crucible. This device contains a gas feed, through which the optional gases can be introduced into the metal flow. This can be desirable under certain circumstances, but in many cases it is disadvantageous, namely when properties of the melt are thereby influenced in an unfavorable and undesired manner. The regulation of the flow takes place with such nozzles, either by so-called stopper rods which are lowered from above into the upper opening of the device and close the opening or leave it wholly or partially open, or by slides which are pushed laterally and perpendicular to the flow direction across the cross section of the nozzle and thereby close it. Such a control process is relatively inexact and mechanically expensive. Moreover, as a rule, it leads to the formation of turbulence within the metal flow, whereby an adhesion of the through-flowing metal takes place on the wall of the nozzle.

Similar nozzles are described in Japanese published patent application (kokai) JP 61-42899 or European patent no. EP 379 647 B1.

BRIEF SUMMARY OF THE INVENTION

An object of the present invention is to make available a nozzle which improves the known solutions of the prior art and ensures a nearly trouble-free running out of the molten metals into a further melt crucible.

The objective is accomplished according to the invention for a nozzle of the type mentioned at the outset, wherein the discharge duct has an upper part and a lower part, the surface of the upper part delimiting the flow passage is made of a different material than the surface of the lower part delimiting the flow passage, and the lower part is fixed in or on the upper part. By "a different material" the material composition or the structure is understood.

A further embodiment of the invention is characterized by the discharge duct having an upper part and a lower part, the lower part being fixed in or on the upper part, and the diameter of the flow passage being greater in the upper part than in the lower part. By a discharge duct is understood a component having a through opening with a preferably cylindrical or conical inner surface or a combination of several surface forms.

With the features of the invention an optimal passage of the molten metals through the nozzle can be achieved. With the different material configuration an adhesion of the molten metals is diminished or even totally avoided. With a smaller diameter of the flow passage in the lower part, first of all, a calibration of the metal flow can take place, which increases flow speed. Second, an accumulation of the molten metal is created in the upper part, so that the occurrence of a diminished pressure is prevented and, as a result, no gases can penetrate through the wall of the nozzle into the flowing metal melt. A turbulence-free flow is attained, and the adherence of melts to the walls of the nozzle is almost completely avoided.

It is particularly advantageous that the material defining the flow passage and the construction of the upper part is thermally highly insulating, at least at temperatures of about 1400° C. to 1650° C. (that is, at steel manufacturing temperatures), highly pure, chemically inert toward steel, and highly temperature-resistant, and that the material of the lower part delimiting the flow passage is a refractory ceramic. By "highly insulating" is understood a material with a coefficient of thermal conductivity of at most 1.5 $Wm^{-1}K^{-1}$, "highly pure" means a purity of >99% by weight, and "highly temperature-resistant" means materials with a melting point of >1800° C. This ensures that no heat is withdrawn from the melt and that it is not contaminated. On the other hand, such an apparatus has long term stability in relation to molten metals.

It is particularly advantageous if the material delimiting the flow passage of the lower part is formed from aluminum oxide or zirconium dioxide with a preferably dense surface delimiting the flow passage, if the material delimiting the flow passage of the upper part is made of aluminum oxide spheres, hollow spheres of refractory oxides, foam ceramics or fiber material, or of a dense material back-filled with at least one of the previously mentioned materials, or of a mixture of the previously mentioned materials. The surface of the material should appropriately be dense in the region of the flow passage, particularly in the upper part. The material itself or the filling therewith can be porous.

The material of the upper part delimiting the flow passage can also be made of a mixture essentially formed of aluminum oxide and graphite. Mullite, zirconium dioxide or calcium oxide can also be used as materials for the upper part. Advantageously, the housing can be made of metal, particularly of steel, ceramics or another refractory material, in order to ensure a high strength. A steel housing in particular prevents undesired gas penetration.

Expediently, the material of the lower part delimiting the flow passage is at least partially surrounded by a heater, in order to make possible a preheating of the nozzle and thereby to prevent thermal stresses or to promote an adhesion-free flow. The heater is advantageously made of at least one material selected from the group of molybdenum, carbon, nickel—chromium, iron—chromium—aluminum. Between heater and housing, a thermally highly insulating material is advantageously arranged, in order to avoid an escape of heat to the outside. It is advantageous if the diameter of the flow passage in the lower part is smaller than the diameter of the flow passage in the upper part, in order to achieve the advantages already described above with respect to the second embodiment of the invention.

BRIEF DESCRIPTION OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings:

The sole FIGURE is a schematic cross sectional representation of the refractory nozzle of the invention.

DETAILED DESCRIPTION OF THE INVENTION

Figure 1:
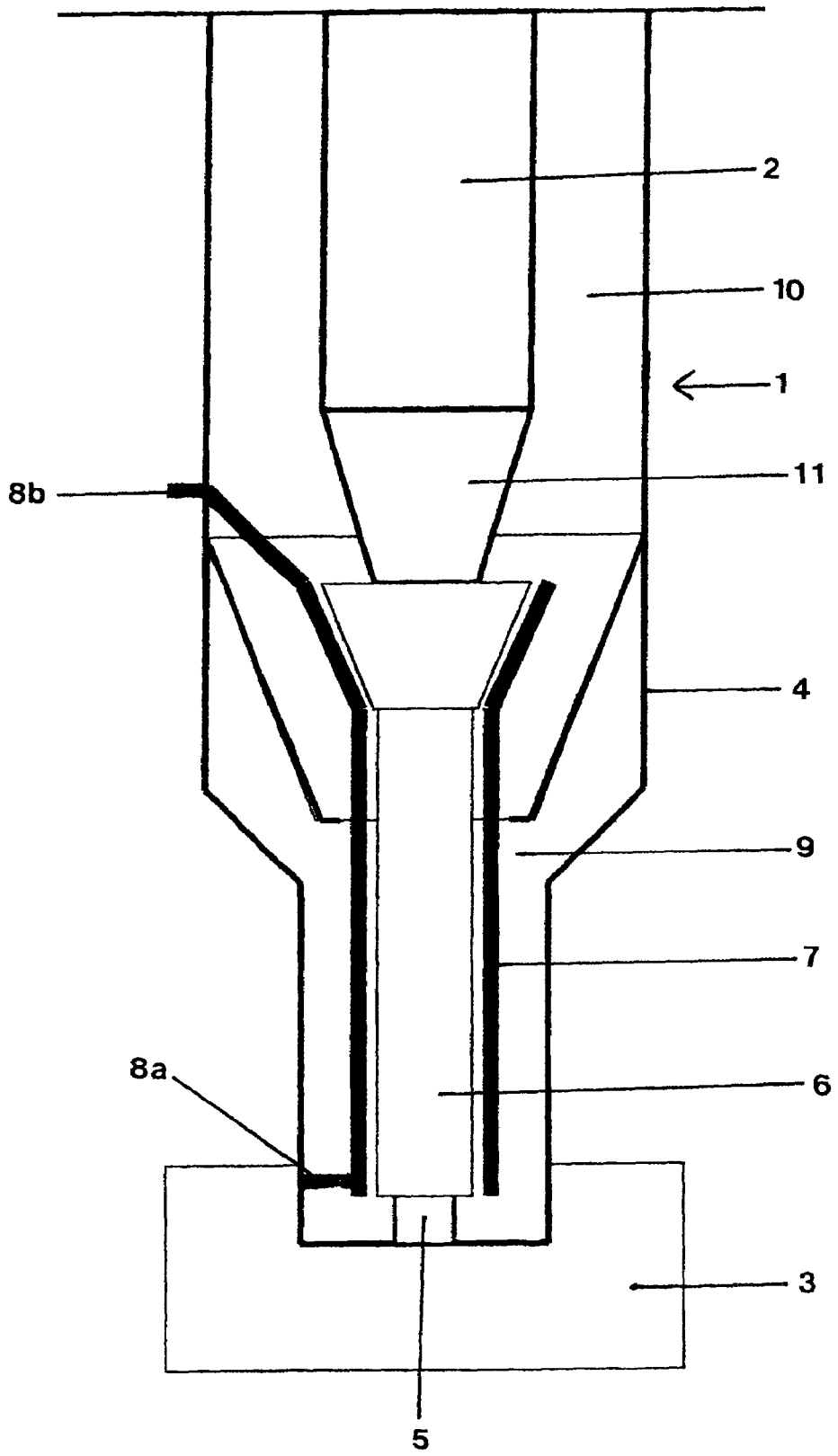

In the sole FIGURE of drawings, above the nozzle 1, a crucible containing a steel melt (not shown) is arranged, from which molten steel runs through the flow passage 2 out into a melt crucible 3 arranged below the nozzle. The nozzle is surrounded by a steel housing 4, which has an opening 5 on its lower end, the diameter of the opening 5 being at least as large as the diameter of the lower part 6 of the nozzle. The lower part 6 of the nozzle is made of zirconium dioxide. It has an inner diameter of about 13 to 16 mm. The lower part 6 is laterally surrounded by a heater 7 with connections 8*a*, 8*b*. Between heater 7 and housing 4 a thermally highly insulating material 9 is arranged, in order to avoid a loss of heat toward the outside.

The material of the upper part 10 is, for example, aluminum oxide. The flow passage 2 has a diameter in the area of the upper part 10, which is larger by about 30 to 40 mm than the diameter of the lower part 6. The flow passage 2 tapers conically toward the lower part in a transition region 11.

The closure of the nozzle at its upper end can take place by stopper rods or slides (not shown), wherein these either close the nozzle completely or open it completely, so that the above described disadvantages due to partial opening and the consequently resulting regulation are dispensed with in the arrangement of the invention.

It will be appreciated by those skilled in the art that changes could be made to the embodiment described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A refractory nozzle for arrangement in or on a wall of a metallurgical crucible, particularly for steel melts, the nozzle comprising a discharge duct surrounding a flow passage, the discharge duct having a surface delimiting the flow passage and an outer housing (4), the discharge duct having an upper part (10) comprising a foam ceramic material and a lower part (6) with the lower part (6) being fixed on or in the upper part (10), wherein the flow passage is configured differently in the upper part and the lower part by at least one of the following: (a) the surface of the upper part (10) delimiting the flow passage (2) being made of a different material than the surface of the lower part (6) delimiting the flow passage (2) and (b) a diameter of the flow passage (2) in the upper part (10) being larger than a diameter of the flow passage (2) in the lower part (6).

2. The refractory nozzle according to claim 1, wherein the material and construction of the upper part (10) delimiting the flow passage (2) is thermally highly insulating at temperatures of about 1400° C. to 1650° C., is highly pure, is chemically inert toward steel, and is highly temperature-resistant, and wherein the material of the lower part (6) delimiting the flow passage (2) is a refractory ceramic.

3. The refractory nozzle according to claim 1, wherein the material of the lower part (6) delimiting the flow passage (2) is selected from the group consisting of aluminum oxide and zirconium dioxide.

4. The refractory nozzle according to claim 1, wherein the housing (4) is made of a material selected from the group consisting of metal, ceramics, and other refractory materials.

5. The refractory nozzle according to claim 4, wherein the housing (4) comprises steel.

6. The refractory nozzle according to claim 1, wherein the diameter of the flow passage (2) in the lower part (6) is smaller than the diameter of the flow passage (2) in the upper part (10).

* * * * *